US005080596A

United States Patent [19]

Viselli et al.

[11] Patent Number: 5,080,596

[45] Date of Patent: Jan. 14, 1992

[54] CONNECTOR WITH CONTACT SPACER PLATE PROVIDING GREATER LATERAL FORCE ON REAR CONTACTS

[75] Inventors: Michael A. Viselli, Elizabethtown; Robert N. Whiteman, Jr., Middletown, both of Pa.

[73] Assignee: AMP Incorporated, Harrisburg, Pa.

[21] Appl. No.: 620,602

[22] Filed: Nov. 30, 1990

[51] Int. Cl.[5] ..... H01R 9/09

[52] U.S. Cl. ..... 439/79

[58] Field of Search ..... 439/78, 79, 80, 83, 439/444

[56] References Cited

U.S. PATENT DOCUMENTS

| | | | |
|---|---|---|---|
| 3,288,915 | 11/1966 | Hatfield et al. | 174/94 |
| 3,493,916 | 2/1970 | Hansen . | |
| 3,551,877 | 12/1970 | Telmosse et al. . | |
| 4,080,041 | 3/1978 | Hawkins, Jr. . | |
| 4,210,376 | 7/1980 | Hughes | 439/80 X |
| 4,225,209 | 9/1980 | Hughes . | |
| 4,491,376 | 1/1985 | Gladd et al. . | |
| 4,550,962 | 11/1985 | Czeschka . | |
| 4,660,911 | 4/1987 | Reynolds et al. . | |
| 4,697,864 | 10/1987 | Hayes et al. | 439/444 |
| 4,789,346 | 12/1988 | Frantz | 439/80 |
| 4,802,860 | 2/1989 | Kikuta | 439/79 |
| 4,818,239 | 4/1989 | Erk | 439/79 |
| 4,842,528 | 6/1989 | Frantz | 439/80 |
| 4,857,017 | 8/1989 | Erk | 439/79 X |
| 4,908,335 | 3/1990 | Cosmos et al. | 439/609 X |

FOREIGN PATENT DOCUMENTS 60-175926 6/1985 Japan .

*Primary Examiner*—Neil Abrams
*Assistant Examiner*—Khiem Nguyen
*Attorney, Agent, or Firm*—David L. Smith

[57] ABSTRACT

There is disclosed an electrical connector (20) having a mating face (26) and a rear housing face (28) and a plurality of contact receiving passages (32) extending therebetween. A spacer plate (22) extends rearwardly from proximate the rear housing face (28) to a rear face (52) and extends laterally between first and second flanges (202,302). The spacer plate (22) has a plurality of solder tail receiving channels (42) extending forward from the rear face (52) toward the rear housing face (28) for receiving one or more solder tails (40) of contacts (34). A plurality of contacts (34) secured in the housing (24) with each contact (34) having a solder tail (40) defining side profile edges (90,92). The channels (42) extend through the spacer plate (22) from a first surface (76) to a second surface (404) and are further defined by opposed sidewalls (400,402) having portions in the region where solder tails are positioned that are substantially the same width.

8 Claims, 8 Drawing Sheets

FIG. 10
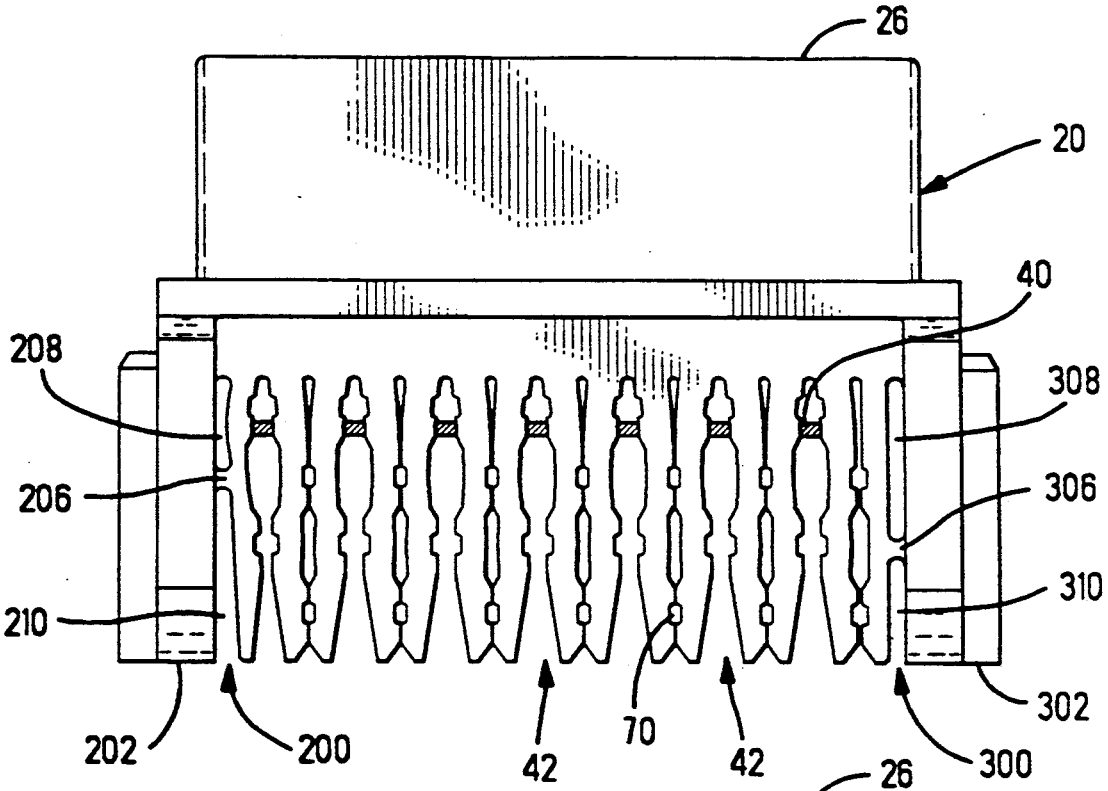
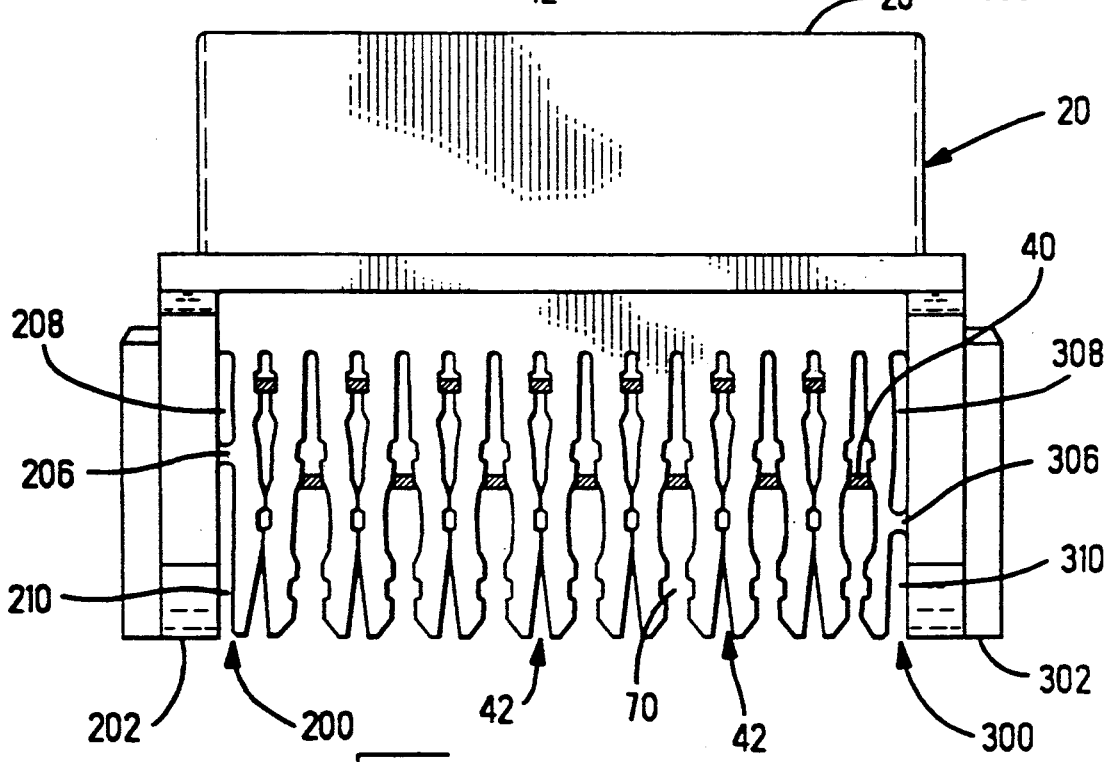
FIG. 11

FIG. 12
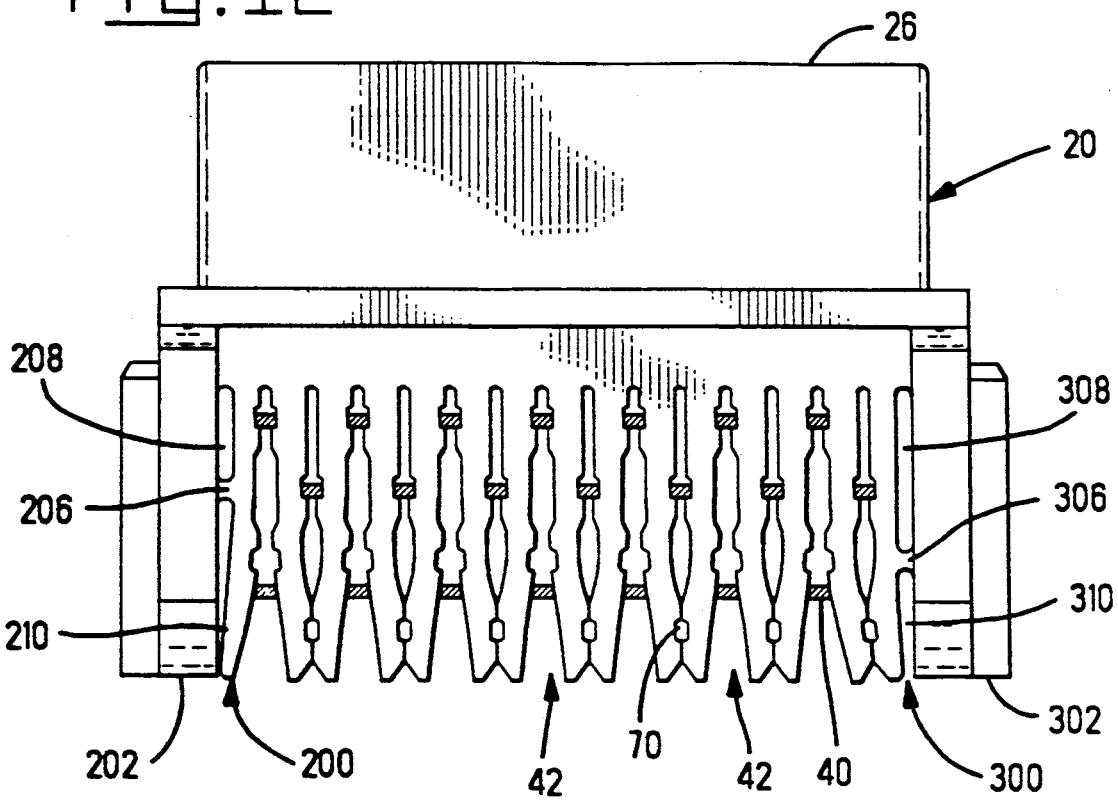
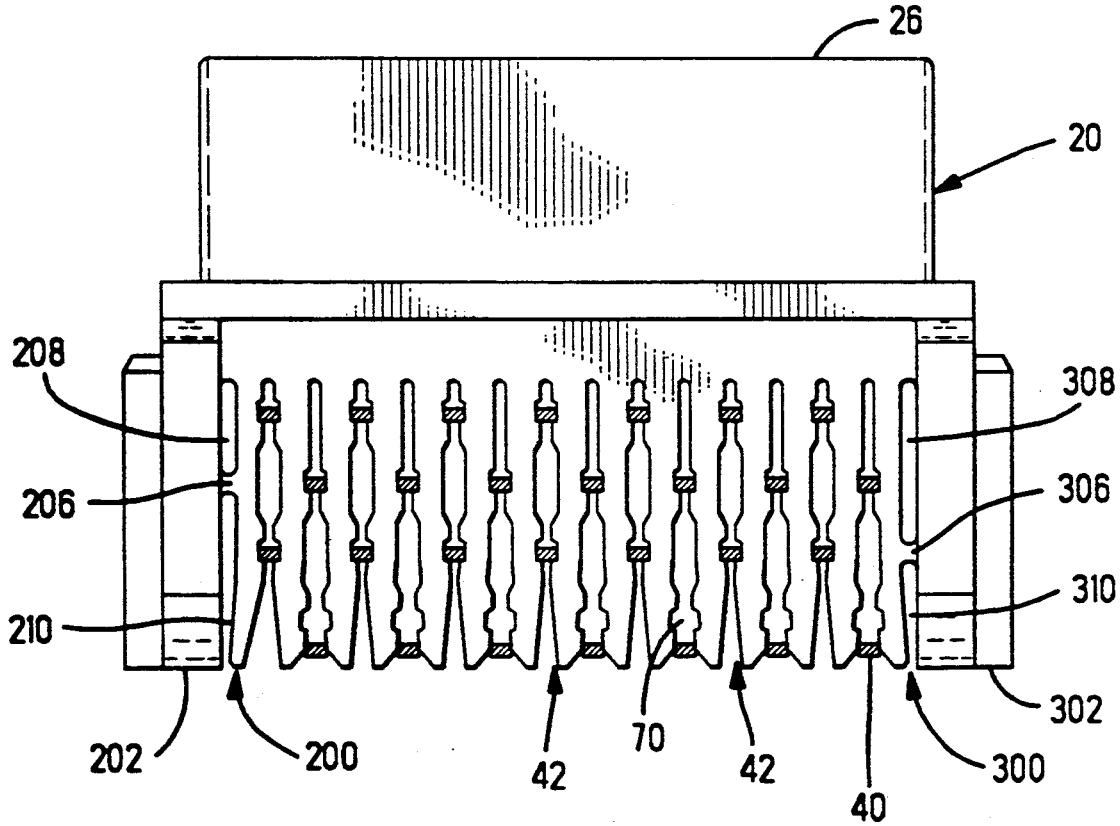
FIG. 13

FIG. 15
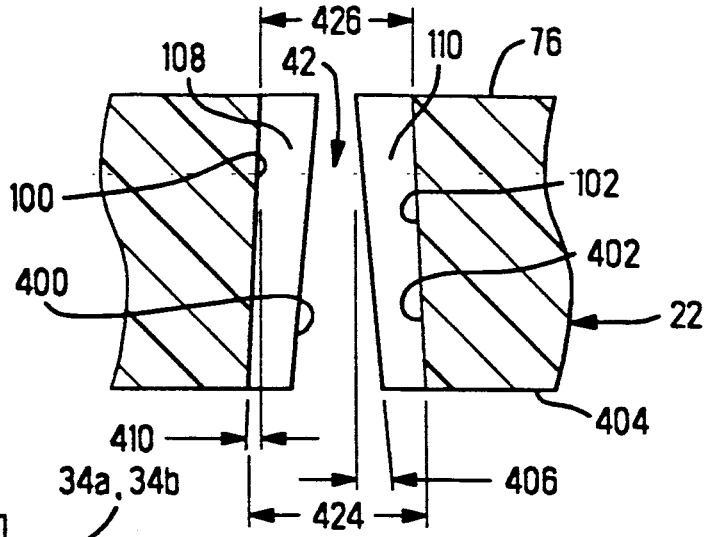
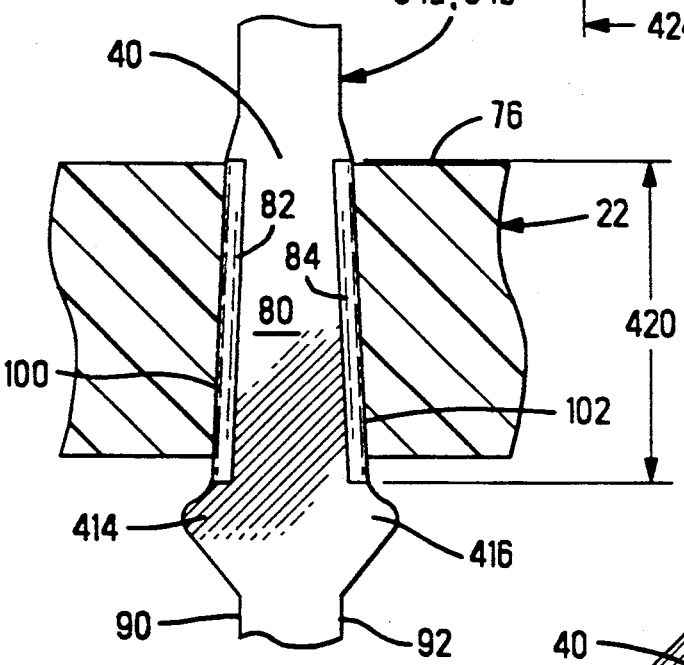
FIG. 17
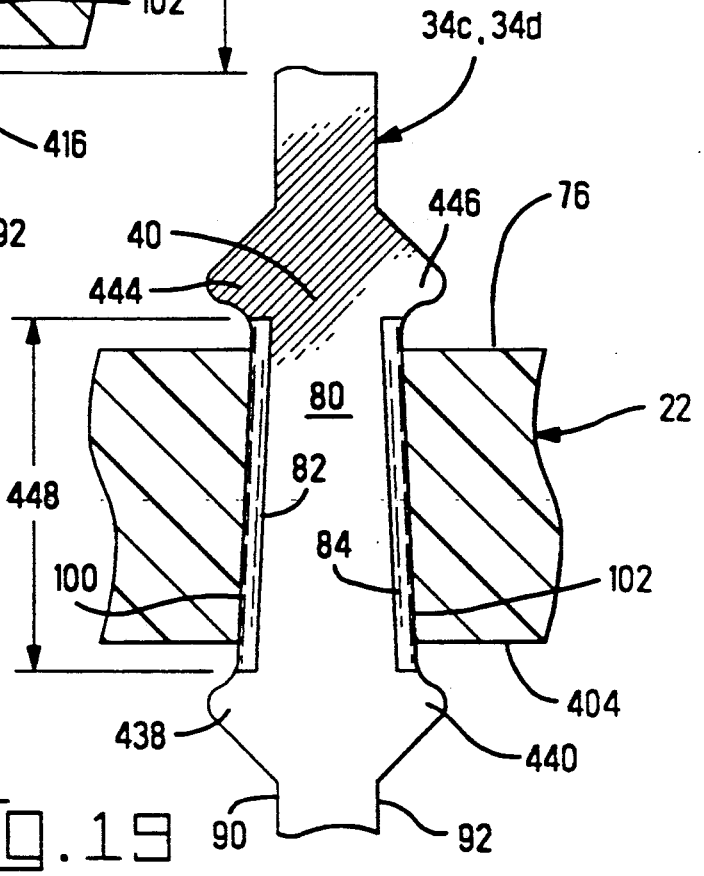
FIG. 19

CONNECTOR WITH CONTACT SPACER PLATE PROVIDING GREATER LATERAL FORCE ON REAR CONTACTS

BACKGROUND OF THE INVENTION

The present invention relates to electrical connectors and in particular to a solder tail alignment and retention system for right angle connectors in which a greater lateral force is applied to the contacts in a rear row of contacts in the solder tail spacer plate than is applied to contacts in more forward rows of contacts.

Right angle connectors are typically mounted on a circuit board. A complementary connector mates with the right angle connector in a direction parallel to the circuit board. Contacts in the right angle connector have a mating portion that is parallel to the circuit board and a solder tail that is formed perpendicular to the circuit board on which the connector is mounted. The solder tails are interconnected with circuits on the printed circuit board. The solder tails may be either for surface mount or through hole mount. Surface mount solder tails extend to land interconnected with circuits on the side of the circuit board on which the connector is mounted. Solder tails for through hole mounting extend into plated through holes in the circuit board and are soldered thereto. The array of circuit board through holes or the array of lands for surface mounting have the same pattern and spacing as the solder tails extending from the connector.

Horizontal positioning of connector solder tails has long been important to assure that a mass produced connector having a predetermined solder tail array pattern would be compatible with a mass produced circuit board having a corresponding array of plated through holes or pads. Various approaches have been taken to maintain the solder tails in the desired predetermined array configuration. One approach has been to make connector housings in multiple parts, one of which is a locator plate having an array of apertures corresponding to the pattern and spacing of solder tails extending from the mounting face of the connector. After all of the contacts are inserted into the connector housing, the locator plate is passed over the solder tails from the ends thereof and secured to the connector housing as disclosed in U.S. Pat. No. 4,080,041. In this typical spacer plate, each solder tail is received in a respective aperture in the locator plate.

Where the locator plate is integral with the insulative housing of the connector, another approach such as a slotted locator plate may be used. There are variations to this design. With contacts inserted into contact receiving passages in a connector, solder tails may be bent into the slots of the locator plate to form a right angle with respect to the mating portion of the contacts. U.S. Pat. No. 4,210,376 discloses such a right angle connector in which contacts adjacent to their lower ends are provided with retaining lances. The lances are received in recesses in the sidewalls of the channels of the spacer plate to retain the contacts in the channels. When drawn wire contacts are used alternately deep and shallow channels may be used. The channels have extremely narrow entrance portions and enlarged inner ends. The inner ends should be dimensioned to accommodate the wire conductors and the narrow entrance portions should have a width such that the conductors must be forced into the channels.

U.S. Pat. No. 3,493,916 discloses a right angle connector having a plurality of terminals which have a rearward end portion extending through either a first series of relatively long slots or a second series of relatively short slots in a rearwardly extending flange portion of the connector. U.S. Pat. No. 4,491,376 employs a slotted locator plate in which the slots are narrower in width than the solder tails. Each slot is aligned vertically with a contact receiving passage in both rows of contact receiving passages. Each slot has two detents formed by recesses in the otherwise parallel walls of the locator plate slots. The lower row of solder tails is bent about an anvil and forced into the forward detents in the locator plate slots. Subsequently, the upper row of solder tails is bent and forced into the rear detents of the locator plate slots.

U.S. Pat. No. 4,789,346 discloses a right angle connector having a solder post alignment and retention system in which contacts are inserted into all of the contact receiving passages in a row simultaneously. Concurrently therewith the solder posts are inserted into alternate profiled channels in the solder post spacer plate. As the solder posts are inserted into the channels, the portion of the post spacer plate between adjacent channels deflect laterally with a different effective beam length for each row of contacts inserted. The contacts seat in detents in respective channels.

Vertical position, although important, has been inspected upon manual mounting of a connector on a circuit board to assure that solder tails extend beyond the printed circuit board a sufficient distance to provide a good solder joint. With the advent of robotic installation of connectors on printed circuit board, maintaining the vertical position of solder tails such as during shipping and handling as well as stuffing onto the board is more critical. For robotic assembly it is important to know precisely where each feature of a connector assembly is relative to a datum reference on the connector assembly. The location of an important feature is the end of the solder tails to assure that during robotic stuffing of a printed circuit board the solder tail ends enter a corresponding array of plated through holes in a circuit board. Should the solder tails ride up during insertion of the solder tails into the array of through holes, such as due to stubbing, frictional engagement between a solder tail and a through hole, or due to a centering action as the tapered end of a solder tail is urged toward the center of a through hole, a sufficient length of the solder tail may not extend beyond the lower surface of the printed circuit board to provide an acceptable solder joint.

For example, for a 0.062 inch thick circuit board the solder tails should extend approximately 0.062 inches below the board for soldering. During assembly of a connector, the tip of the solder tails are therefore positioned 0.125 inches below the housing mounting face with an allowance for a tolerance to assure that the solder tails will extend beyond the circuit board an appropriate distance for an acceptable solder joint.

U.S. Pat. No. 4,842,528 discloses a right angle connector having solder tail receiving channels in the spacer plate thereof. The solder tails have stop means extending outwardly from the solder tails below, or both above and below, the spacer plate to prevent the solder tails from moving axially in the direction of the solder tail through the spacer plate. In this manner, the solder tail ends are maintained in a known position.

It would be desirable to have a solder tail retention system for maintaining solder tails in a predetermined position relative to a solder tail spacer plate and to assure the true position of the distal end of the solder tails.

SUMMARY OF THE INVENTION

In accordance with the present invention, a dielectric housing having a mating face and a rear housing face has a plurality of contact receiving passages extending therebetween. A spacer plate extends rearwardly from proximate the rear housing face to a rear face and extends laterally between first and second flanges. The spacer plate has a plurality of solder tail receiving channels extending forward from the rear face toward the rear housing face for receiving one or more solder tails of contacts. A plurality of contacts secured in the housing with each contact having a solder tail defining side profile edges. The channels extend through the spacer plate from a first surface to a second surface and are further defined by opposed sidewalls having portions in the region where solder tails are positioned that are substantially the same width. The solder tails forming at least two rows across the width of the spacer plate with the solder tails received in the rearward row being wider than the solder tails in the more forward row.

BRIEF DESCRIPTION OF THE DRAWING

FIG. 10 is a top view of the spacer plate of FIG. 2 with the forward most row of solder tails being passed into the final restriction before seating in a forward detent;

FIG. 11 is a top view of the spacer plate of FIG. 2 with the forward most row of solder tails in detents and the second row of solder tails being passed into the final restriction before seating in a detent;

FIG. 12 is a top view of the spacer plate of FIG. 2 with the first and second rows of solder tails in detents and the third row of solder tails being passed into the final restriction before seating in a detent;

FIG. 13 is a top view of the spacer plate of FIG. 2 with the first, second and third rows of solder tails in detents and the fourth row of solder tails being passed into the final restriction before seating in a detent;

FIG. 15 is a partial sectional view taken along the lines 15—15 of FIG. 2 showing the tapered sidewalls of a channel and a detent;

FIG. 17 is an enlarged partial sectional view of a solder tail in one of the front row detents of the spacer plate;

FIG. 19 is an enlarged partial sectional view of a solder tail in one of the rear row detents of the spacer plate.

DESCRIPTION OF THE PREFERRED EMBODIMENT

Figure 1:
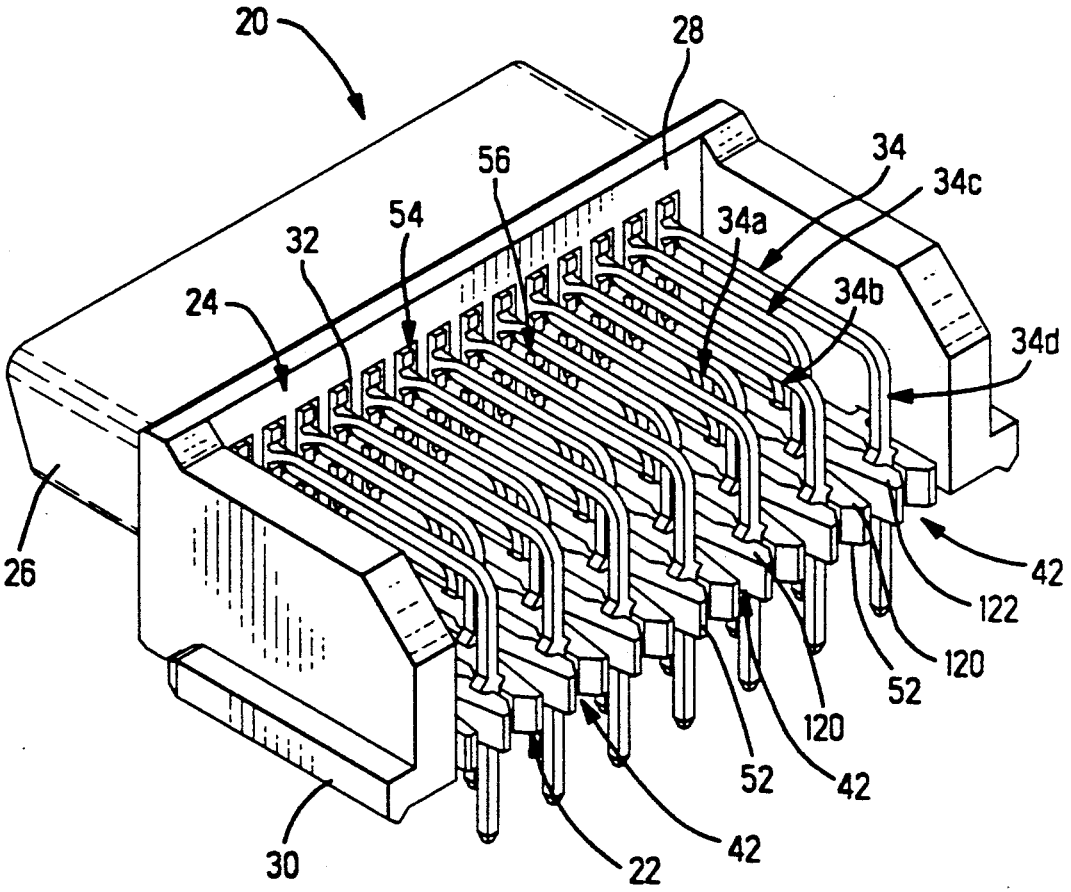
FIG. 1 is a perspective view of a connector including the equal lateral force spacer plate of the present invention.

A connector 20 including a solder tail spacer plate 22 having channels 42 with tapered sidewalls and solder tails 40 with sections tapered to conform thereto in accordance with the present invention is shown in FIG. 1. Connector 20 includes a dielectric housing 24 molded of an appropriate plastic having mating face 26, opposed rear housing face 28 and mounting face 30 at a right angle to mating face 26. A plurality of contact receiving passages 32 extend from mating face 26 toward and opening onto rear housing face 28 with contacts 34 secured therein. Contacts 34 have a mating portion 36 extending into contact receiving passages 32 from rear housing face 28 that may be either pins or sockets and mounting portions 38, typically solder tails 40, that extend rearward from rear housing face 28 then are formed downward at a right angle to extend into and through a channel 42 in spacer plate 22. In the preferred embodiment, spacer plate 22 is molded to be integral with housing 24, although the invention is not limited thereto.

Figure 3:
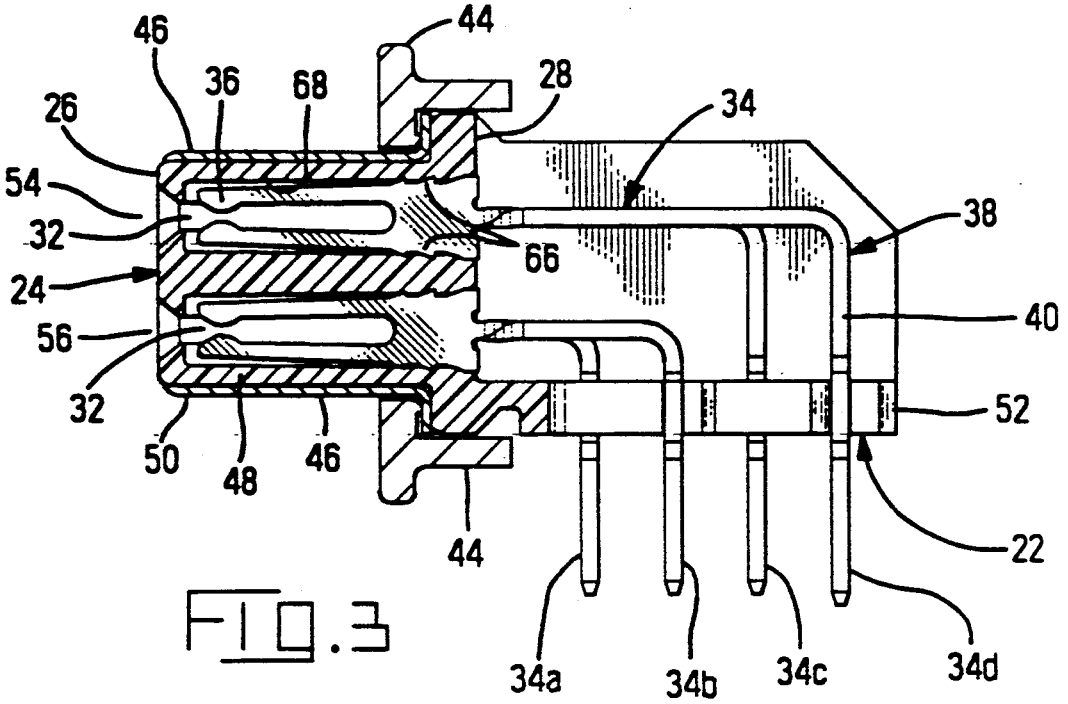
FIG. 3 is a side sectional view of a shielded connector incorporating the present invention.

A shielded version of connector 20 would include an electrically conductive member surrounding at least a portion of housing 24, such as die cast member 44 and drawn shell 46 as shown in FIG. 3. As also seen in FIG. 3, spacer plate 22 is substantially parallel to contact receiving passages 32, is located below the lower row of passages 56 and extends rearwardly from rear housing face 28 of housing 24.

Electrically conductive shell 46 has a similar outer profile to the formed raised portion 48 of housing 24. Shroud 50 extends forward from the die cast member 44 and conforms to and encloses the forward raised portion 48 of housing 24. Shroud 50 may have a trapezoidal or subminiature D shape to provide a polarization feature.

Contacts 34 are formed on a strip on the desired centerline spacing. The contacts are received in two rows of contact receiving passages 54 and 56 and have mounting portions 38 formed to define four rows 58,60,62 and 64 of staggered solder tails 40. During fabrication of connector 20, contacts 34 having formed mounting portions 38 are inserted into contact receiving passages 32 from rear housing face 28 substantially as disclosed in U.S. Pat. No. 4,789,346, the disclosure of which is hereby incorporated by reference. As the mating portion 36 is received in passage 32, the solder tail is passed into a respective channel 42 from rear face 52 of spacer plate 22. Mating portion 36 is secured in passage 32 by barbs 66 engaging sidewalls 68 in an interference fit.

Figure 2:
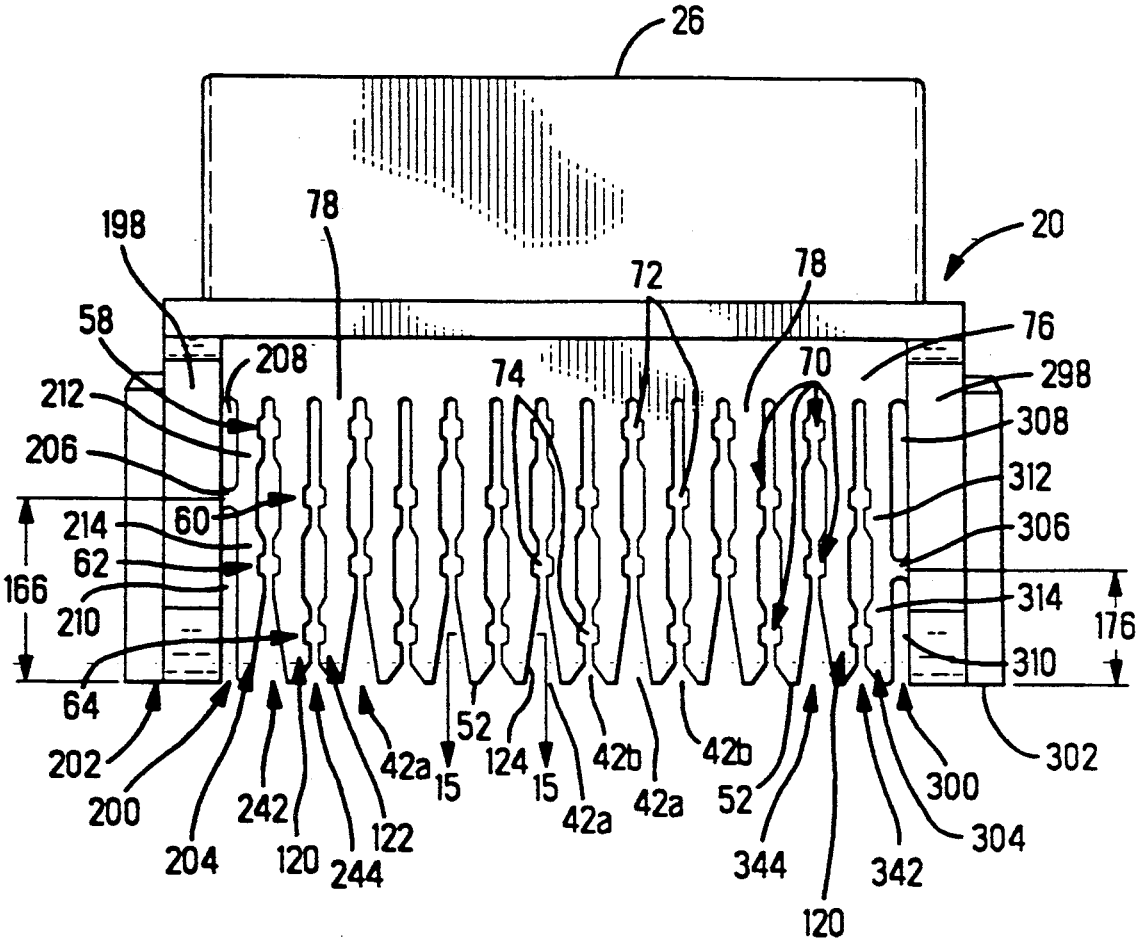
FIG. 2 is a top view of the connector of FIG. 1 with the contacts removed, showing the spacer plate.

FIG. 2 shows a top view of connector 20 without contacts 34 so that spacer plate 22 is more readily visible. Each channel 42 in the preferred embodiment has a pair of spaced detents 70, a forward detent 72 and a rearward detent 74, although the invention is not limited thereto. Each detent 70 in a channel 42 receives a respective solder tail from contacts 34 mounted one each in the contact receiving passages in rows 54 and 56 laterally aligned with channel 42. The staggering of solder tails 40 is achieved by positioning spaced detents 70 closer to rear housing face 28 in alternating channels 42, defining channels **42*a* than in the alternate channels 42 defining channels 42*b*. The detents form four rows of detents. All detents in each row of detents are spaced equidistant from rear housing face 28, and since rear face 52 is parallel to rear housing face 28, all detents in each row of detents are spaced equidistant from rear face 52**.

Contacts 34, designated contacts **34*a* when their solder tails are destined to be received in row 58, are pressed into alternate contact receiving passages 32 in the lower row 56 of passages; simultaneously the solder tails 40 of contacts 34*a* are pressed into respective channels 42*a* aligned with passages 32 and secured in the forward most detent 72. The solder tails of contacts 34*a* form row 58**.

Next, contacts, designated contacts **34*b*, are pressed into the remaining alternate contact receiving passages 32 in the lower row 56 of passages; simultaneously, the solder tails 40 of contacts 34*b* are passed into respective channels 42*b* aligned with passages 32 and received in the forward most detent 72. The solder tails of contacts 34*b* form row 60**.

Subsequently, contacts designated contacts **34*c*, are pressed into alternate contact receiving passages 32 in the upper row 54 of passages while simultaneously the solder tails 40 of contacts 34*c* are passed into respective channels 42*a* aligned with passages 32 and received in the rearward detent 74. The solder tails of contacts 34*c* form row 62**.

Thereafter, contacts designated contacts **34*d*, are pressed into the remaining alternate contact receiving passages 32 in upper row 54 of passages; simultaneously, the solder tails 40 of contacts 34*d* are passed into respective channels 42*b* aligned with passages 32 and received in the rearward detent 74. The solder tails of contacts 34*d* form row 64**.

Each channel 42 has an opening onto rear face 52 that widens to facilitate insertion of solder tails 40 thereinto. Between channels 42 the spacer plate is formed into beams integral with the spacer plate at forward end 78 thereof and extending to a free distal end proximate rear face 52. Channels **42*a* widen over a greater length of channel 42 than do channels 42*b* due to the rearward detent 74 being recessed farther into channels 42*a* than channels 42*b***.

Figure 4:
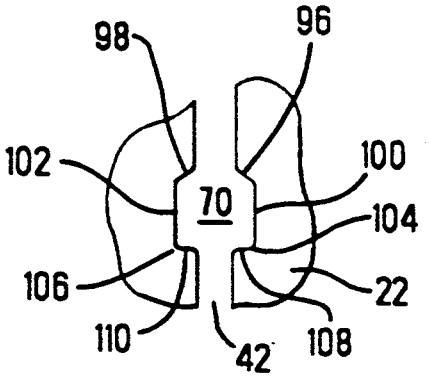
FIG. 4 is a partial plan view, partially in section, showing a detent at a mid-point along a channel in the spacer plate.
Figure 5:
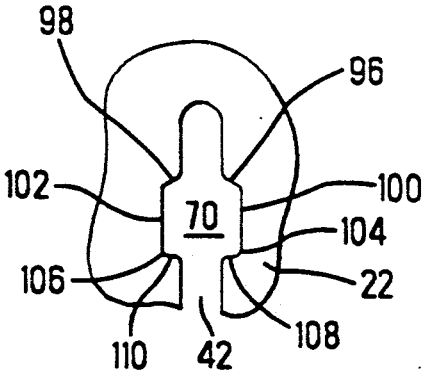
FIG. 5 is a partial plan view, partially in section, showing a detent at the innermost end of a channel in the spacer plate.
Figure 6:
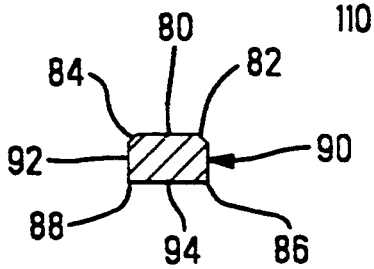
FIG. 6 is a cross section of a solder tail at the plane of the upper surface of the spacer plate.

FIG. 4 shows a typical mid-channel detent 70 in either of channels **42*a* or 42*b* in spacer plate 22. FIG. 5 shows a typical forward most detent 72 in channel 42*a*. FIG. 6 shows the cross section of a solder tail at the plane of the upper surface 76 of spacer plate 22. The leading surface 80 has beveled corners 82,84 to engage sidewalls of the channels during insertion of solder tails and to facilitate the beams adjacent to the channels to bias or deflect the beams to thereby permit passage of solder tail 40 therebetween. The trailing corners 86,88** are sharp.

Each solder tail 40 may be secured in a detent 70 by a slight compression fit. A small lateral force may be maintained on each solder tail in a detent to assure that the solder tail is retained therein. Detent 70 is shaped substantially as the cross section of a solder tail 40, as best seen by comparing FIGS. 4 and 5 to FIG. 6.

Figure 7:
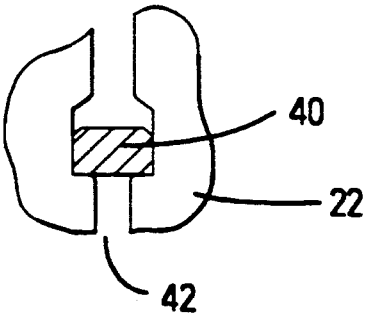
FIG. 7 is the view of the spacer plate shown in FIG. 4 with the solder tail of FIG. 6 received in the detent.
Figure 8:
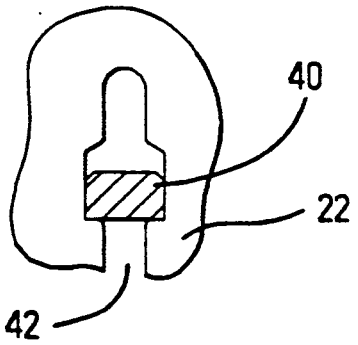
FIG. 8 is the view of the spacer plate shown in FIG. 5 with the solder tail of FIG. 6 received in the detent.

FIGS. 7 and 8 show a solder tail 40 received in detents 70 of FIGS. 4 and 5 respectively. The beveled corners 82,84 are tapered to engage surfaces 96,98 of the channel sidewalls as a solder tail is pressed forward through the channel to pass through a detent. Sides 90 and 92 of solder tail 40 substantially engage sidewalls 100 and 102 of detent 70. Trailing corners 86,88 engage rear corners 104 and 106, which are slightly rounded due to the manufacturing process, in an interference fit. Trailing edge 94 of solder tail 40 is substantially against rearwalls 108,110.

As best seen in FIG. 2, the spacer plate 22 between adjacent channels **42*a* and 42*b* form beams that bias or deflect laterally with an effective beam length when a solder tail 40 is passed into a channel 42 to be secured in a detent 70. Each beam extends from a distal end at rear face 52 forward to the depth of the channels adjacent to the beam where each beam is integral with spacer plate 22 at forward end 78. There are two types of beams, beam 120 and beam 122, defined between adjacent channels 42**.

Figure 9:
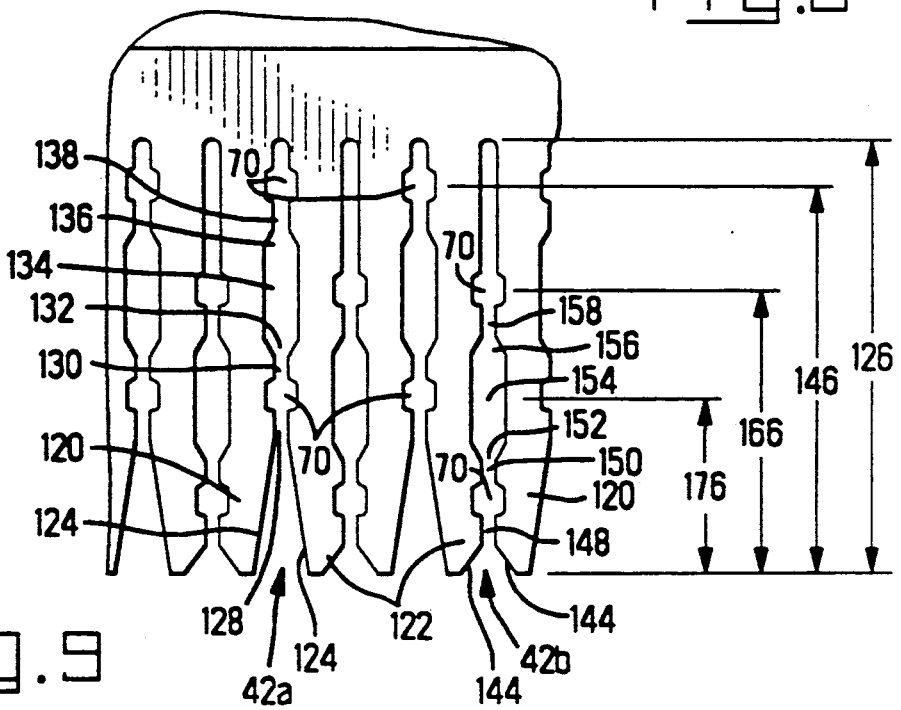
FIG. 9 is an enlarged partial plan view of the spacer plate showing two typical adjacent channels.

Contacts **34*a* are the first to be inserted into housing 24. With reference to FIGS. 2, 9 and 10, as contacts 34*a* are being inserted into a channel 42*a*, beam 122 is on the left and beam 120 is on the right. As solder tails 40 are passed between tapered lead-in surfaces 124, beam 122 is resiliently deflected laterally to the left and beam 120 is resiliently deflected laterally to the right with an effective beam length for both beams of length 126. Solder tails 40 then enter a first region 128 of channel 42*a* having substantially parallel walls. Solder tail 40 next enters rearward detent 74 whereupon beams 120 and 122** resile, returning toward their unbiased or undeflected position.

Continued movement of mating portion 36 into passage 32 and passage of solder tail 40 through channel **42*a* causes beveled corners 82,84 to react with tapered surfaces 96,98 of rearward detent 74 to cause beams 120 and 122 to again laterally resiliently deflect or bias with beam 120 deflecting to the left and beam 122 deflecting to the right. These beams still have an effective beam length of length 126**.

Solder tail 40 enters and passes through a second region 130 of channel **42*a*** having substantially parallel walls.

Solder tail 40 then passes through a first transition region 132 in channel **42*a* that widens in the direction of insertion of solder tail 40, which again allows beams 120 and 122 to resile toward their unbiased position. Solder tail 40 then passes into and through a third region 134 of channel 42*a* having substantially parallel walls. As solder tail 40 passes through the third region, beams 120 and 122** remain in their substantially unbiased position.

Solder tails 40 then pass through a second transition region 136 in channel **42*a* that narrows in the direction of insertion of solder tails 40. The reaction between the beveled corners 82,84 and the sidewalls of the transition region 136 cause beam 120 to again resiliently deflect or bias to the left and beam 122 to again resiliently deflect or bias to the right, both with an effective beam length of length 126**.

Solder tails 40 then move into and through a fourth region 138 of channel 42*a* having substantially parallel walls. Solder tails 40 of contacts 34*a* then enter forward detent 72 of channel 42*a* whereupon beams 120 and 122 resile, returning toward their unbiased or undeflected position to secure solder tail 40 in forward detent 72.

The next contacts to be inserted into housing 24 are contacts 34*b* which are inserted into channel 42*b*. With reference to FIGS. 2, 9 and 11, as contacts 34*b* are being inserted into a channel 42*b*, beam 120 is on the left and beam 122 is on the right. At this point in assembly, the solder tails of contacts 34*a* are secured in detent 72 of channels 42*a*.

As solder tails 40 are pressed between tapered lead-in surfaces 144, beam 120 is resiliently deflected laterally to the left and beam 122 is resiliently deflected laterally to the right with an effective beam length of length 146 since the solder tails 40 of contacts 34*a* are in forward detents 72 of the adjacent channels 42*a*. Solder tails 40 then enter and pass through a first region 148 of channels 42*b* having substantially parallel walls. Solder tails 40 next enter rearward detent 74 whereupon beams 122 and 120 resile, returning toward their unbiased or undeflected position.

Continued movement of mating portion 36 into passage 32 and passage of solder tails 40 through channel 42*b* causes beveled corners 82,84 to react with tapered surfaces 96,98 of rearward detent 74 to cause beams 122 and 120 to again laterally resiliently deflect or bias, with beam 120 deflecting to the left and beam 122 deflecting to the right, with an effective beam length of length 146.

Solder tail 40 then enters and passes through a second region 150 of channel 42*b* having substantially parallel walls. Solder tail 40 then passes through a first transition region 152 in channel 42*b* that widens in the direction of insertion of solder tail 40, which again allows beams 122 and 120 to resile toward their unbiased position. Solder tails 40 then pass into and through a third region 154 of channel 42*b* having substantially parallel walls.

Solder tails 40 then pass through a second transition region 156 in channel 42*b* that narrows in the direction of insertion solder posts 40. The reaction between beveled corners 82,84 and the sidewalls of transition region 156 cause beam 120 to again resiliently deflect or bias to the left and beam 122 to again resiliently deflect or bias to the right, both with an effective beam length of length 146.

Solder tails 40 then move into and through a fourth region 158 of channel 42*b* having substantially parallel walls. Solder tails 40 of contact 34*b* then enter forward detent 72 of channel 42*b* whereupon beams 122 and 120 resile, returning toward their unbiased or undeflected position to secure solder tail 40 and forward detent 72.

The next contacts to be inserted into housing 24 are contacts 32*c* which are inserted into channels 42*a*. With reference to FIGS. 2, 9 and 12, as contacts 34*c* are being inserted into a channel 42*a*, beam 122 is on the left and beam 120 is on the right.

As solder tails 40 are passed between tapered lead-in surfaces 144, beam 122 is resiliently deflected laterally to the left and beam 120 is resiliently deflected laterally to the right with an effective beam length of length 166 since there is a solder tail 40 of contact 34*b* in forward detents 72 of channels 42*b* adjacent to each channel 42*a*. Solder tails 40 enter first region 128 of channels 42*a* then pass into rearward detent 74 whereupon beams 120 and 122 resile, returning toward their unbiased or undeflected position to secure solder tails 40 of contacts 34*c* in rearward detents 74 of channels 42*a*.

The next and last contacts to be inserted into housing 24 are contacts 34*d* which are inserted into channels 42*b*. With reference to FIGS. 2, 9 and 13, as contacts 34*b* are being inserted into a channel 42*b*, beam 120 is on the left and beam 122 is on the right. As solder tails 40 are passed between tapered lead-in surfaces 144, beam 120 is resiliently deflected laterally to the left and beam 122 is resiliently deflected laterally to the right with an effective beam length of length 176. Solder tails 40 pass through first region 148 of channel 42*b* and enter rearward detent 74 whereupon beams 120 and 122 resile returning toward their unbiased or undeflected position to secure solder tails 40 of contacts 34*d* in rearward detents 74 of channels 42*b*.

As best seen in FIG. 2, forward detents 72 in channels 42*a* are laterally aligned and form row 58. Similarly, the forward detents 72 in channels 42*b* are laterally aligned and form row 60. The rearward detent 74 in channels 42*a* are laterally aligned and form row 62. Similarly, the rearward detent 74 in channels 42*b* are laterally aligned and form row 64. In this manner, the two rows 54 and 56 of mating portions of contacts 34 have staggered solder tails forming four rows.

As best seen in FIG. 2, spacer plate 22 has a slot 200 between the final lateral slot 42 and substantially rigid flange 202. The presence of endwall 198 integral with and extending perpendicular to flange 202 enhances the rigidity of flange 202. Slot 200 defines a beam 204 which may be considered a beam 120 or a beam 122 as described above depending upon whether the channel adjacent to slot 200 is a channel 42*a* or a channel 42*b*. As shown in FIG. 2, channel 42*b* is adjacent slot 200 defining beam 204 therebetween. Beam 204 has the characteristics of a beam 122. Absent slot 200, beam 204 would be a portion of flange 202 and would be, like flange 202, substantially rigid.

Beam 204 is bridged to flange 202 at bridging member 206 interrupting slot 200 into forward slot 208 and rear slot 210 and dividing beam 204 into forward beam 212 and rear beam 214. Bridging member 206 is positioned along slot 200 forward of the rearward detent 74, that is spaced away from rear face 52 toward mating face 26, in the adjacent channel 42, laterally aligned with the rearward detent 74 in the channel 42 adjacent to the channel 42 that is adjacent to slot 200. For purposes of discussion, the channel 42 adjacent to slot 200 will be referred to as channel 242 and the channel 42 adjacent to channel 242 will be referred to as channel 244. Thus, bridging member 206 is positioned along slot 200 forward of the rearward detent 74 in channel 242 and laterally aligned with rearward detent 74 in channel 244. In a preferred embodiment, bridging member 206 spans a distance along slot 200 that is substantially the thickness of a solder tail to be received in a detent in one of the channels. In a preferred embodiment, slot 200 extends into spacer plate 22 from rear face 52, substantially parallel to and substantially the same distance as slots 42. Beam 204 has the same mass as beam 122 and in this manner, beam 204 will exhibit the same characteristics as a beam 122 during insertion of solder tails 40 of contacts 34*c* and 34*d* of spacer plate 22.

During insertion of the solder tail 40 of contact 34*a* into slot 242, beam 120 functions as described above. While solder tail 40 is passing between tapered lead-in surfaces 124 and first region 128, beam 204 and more specifically rear beam 214 is resiliently deflected to the left with an effective beam length of length 166 due to beam 204 being bridged to flange 202 by bridging member 206. As solder tail 40 is received in rearward detent 74, rear beam 214 resiles, returning toward its unbiased or undeflected position. As solder tail 40 is moved farther into channel 242 into and through second region 130 and first transition region 132, rear beam 214 is again resiliently deflected to the left with an effective beam length of length 166 then resiles to an unbiased position. Note also that forward beam 212 may flex toward channel 242 since there is no contact in forward detent 70 of channel 242.

As solder tail 40 is moved farther into channel 242, solder tail 40 passes freely through third region 134.

As solder tail 40 enters and passes through second transition region 136 and fourth region 138, forward beam 212 resiliently bows into forward slot 208. Upon solder tail of contact 34*a* moving into forward detent 72 in channel 242, forward beam 212 resiles toward its unbiased position to secure solder tail 40 in detent 72. A small lateral force may be maintained on solder tail 40 of contact 34*a* to assure that the solder tail is retained in detent 72.

During insertion of solder tail of contact 34*c* and channel 242, beam 120 on one side of channel 242 functions as described above and beam 204 on the other side of channel 242 functions like a beam 122 as described above due to solder tail 40 of contacts 34*b* present in forward detent 72 of channel 244, the design of beam 204 to have the same spring characteristics of beam 122, such as by having the same mass or shape, and the presence and location of bridging member 206 in slot 200. As shown in FIG. 12, when solder tail 40 of contact 34*c* is received between tapered lead-in surfaces 124 and passes through first region 128, beam 120 is resiliently deflected to the right with an effective beam length of length 166. Simultaneously, beam 204 is resiliently deflected to the left also with an effective beam length of length 166; forward beam 212 is effectively prevented from bowing due to the presence of solder tail 40 of contact 34*a* and forward detent 72 of channel 242. Thus, beam 204 on one side of channel 242 deflects with the same beam length as beam 120 on the other side of channel 242, with the effective beam length of beam 204 determined by the presence and location of bridging member 206.

As solder tail 40 of contact 34*c* is received in detent 74 of channel 242, beams 120 and 204 resile toward their unbiased or undeflected position to secure solder tail 40 of contact 34*c* in rear detent 74 of channel 242. A small lateral force may be maintained on solder tail 40 of contact 34*c* to assure that the solder tail is maintained in detent 74. Since the effective length of beam 204 that secures solder tail 40 of contact 34*c* in position is the same as the effective length of any beam 120 or 122 securing any of the solder tails of other contacts 34*c* in rearward detents 74 of channels 42*a*, the normal force applied by each beam holding each of the solder tails in a detent 74 in row 62 is substantially equal.

In this manner, bridge member 206 in slot 200 emulates the presence of a solder tail with respect to a rear solder tail in an adjacent channel being inserted and with respect to securing a solder tail in a rearward detent rearward of the bridge member 206 in an adjacent channel 242 in spacer plate 22 wherein the adjacent channel is adjacent to slot 200. Furthermore, the presence of bridging member 206 assures equal lateral normal force on each of the solder tails in a row of solder tails as retained in spacer plate 22.

While beam 204 has been described in the preferred embodiment as being bridged to flange 202 thereby interrupting slot 200, a protrusion extending from flange 202 toward beam 204 or a protrusion extending from beam 204 toward flange 202 or some combination thereof could provide the same function of emulating the presence of a contact to prevent substantial lateral movement of the beam due to the presence of the protrusion between beam 204 and flange 202.

Also as best seen in FIG. 2, spacer plate 22 has a slot 300 between the final lateral slot 42 and substantially rigid flange 302. The presence of endwall 298 integral with and extending perpendicular to flange 302 enhances the rigidity of flange 302. Slot 300 defines a beam 304 which may be either a beam 120 or a beam 122 as described above depending upon whether the channel adjacent to slot 300 is a channel 42*a* or a channel 42*b*. As shown in FIG. 2, channel 42*a* is adjacent to slot 300 thereby defining beam 304 having the characteristics of a beam 120. Absent slot 300, beam 304 would be a portion of flange 302 and would be, like flange 302, substantially rigid.

Beam 304 is bridged to flange 302 by bridging member 306 interrupting slot 300 into forward slot 308 and rear slot 310 as well as dividing beam 304 into forward beam 312 and rear beam 314. Bridging member 306 is positioned along slot 300 forward of rearward detent 74, that is spaced away from rear face 52 toward mating face 26, in the adjacent channel 42, laterally aligned with the rearward detent 74 in the channel 42 adjacent to the channel 42 adjacent to slot 300. For purposes of discussion, the channel 42 adjacent to slot 300 will be referred to as channel 342 and the channel 42 adjacent to channel 342 will be referred to as channel 344. Channel 342 is similar to a channel 42*b* and channel 344 is similar to a channel 42*a*. Thus, bridging member 306 is positioned along slot 300 forward of the rearward detent 74 in channel 342 and laterally aligned with rearward detent 74 in channel 344. In a preferred embodiment, bridging member 306 spans a distance along slot 300 that is substantially the thickness of a solder tail to be received in a detent in one of the channels. In a preferred embodiment, slot 300 extends into spacer plate 22 from rear face 52 substantially parallel to and substantially the same distance as slots 42. Beam 304 has the same mass as a beam 120 and in this manner will exhibit the same spring characteristics as beam 120 during insertion of solder tails 40 of contacts 34*c* and 34*d* into slot 342 and during retention of solder tails 40 of contacts 34*c* and 34*d* in detents 70 of slot 342.

During insertion of a solder tail 40 of contact 34*b* into slot 342, beam 120 functions as described above. While solder tail 40 is passing between tapered lead-in surfaces 144 and first region 148, beam 304, and more specifically rear beam 314, is resiliently deflected to the right with an effective beam length of length 176 due to beam 304 being bridged to flange 302 by bridging member 306. As solder tail 40 is received in rearward detent 74, rear beam 314 resiles returning toward its unbiased or undeflected position. As solder tail 40 is moved farther into channel 342 into and through second region 150 and first transition 152, rear beam 314 is again resiliently deflected to the right with an effective beam length of length 176 then resiles to its unbiased position. Note also that forward beam 312 may flex toward channel 342 as tail 40 is moved through second region 150 and first transition 152 since there is no solder tail in forward detent 72 of channel 342.

As solder tail 40 is moved farther into channel 342, solder tail 40 passes freely through third region 154.

As solder tail 40 enters and passes through second transition region 156 and fourth region 158 in channel 352, forward beam 312 resiliently bows into forward slot 308. Upon solder tail 40 of contact **34*b* moving into forward detent 72 in channel 342, forward beam 312 resiles toward its unbiased position to secure solder tail 40 in detent 72. A small lateral force may be maintained on solder tail 40 of contact 34*b* to assure that the solder tail is maintained in detent 70**.

During insertion of solder tail 40 of contact **34*d* into channel 304, beam 120 on one side of channel 342 functions as described above and beam 304 on the other side of channel 342 functions like a beam 122 as described above due to solder tail 40 of contact 34*c* being present in rear detent 74 of channel 344, the design of beam 304 to have the same mass and spring characteristics of a beam 122 and the presence of and location of bridging member 306 in slot 300. As shown in FIG. 13, when solder tail 40 of a contact 34*d* is received between tapered lead-in surfaces 144 and passes through first region 148, beam 120 is resiliently deflected to the left with an effective beam length of length 176. Simultaneously, beam 304 is resiliently deflected to the right also with an effective beam length of length 176; forward beam 312 is effectively prevented from bowing due to the presence of solder tail 40 of contact 34*b* in forward detent 72 of channel 342. Thus, beam 304 on one side of channel 342 deflects with the same effective beam length as beam 122 on the other side of channel 342, with the effective length of beam 304 determined by the presence and location of bridging member 306. As solder tail 40 of contact 34*d* is received in rearward detents 74 of channel 342, beams 120 and 304 resile toward their unbiased or undeflected position to secure solder tail 40 of contact 34*d* in rear detent 74 of channel 342. A small lateral force may be maintained on solder tail 40 of contact 34*d* to assure the solder tail is maintained in detent 74. Since the effective length of beam 304 that secures solder tail 40 of contact 34*d* in detent 74 is the same as the effective length of any beam 120 or 122 securing any of the other solder tails of contacts 34*d* in a rearward detent of a channel 42*b***, the normal force applied by each beam holding each of the solder tails in a rearward detent is substantially equal.

In this manner, bridge member 306 in slot 300 emulates the presence of a solder tail with respect to securing a solder tail in a rearward detent, rearwardly of bridging member 306, in a channel of spacer plate 22 adjacent to slot 300. Furthermore, the presence of bridging member 306 assures equal lateral normal force on each of the solder tails in a row of solder tails as retained in spacer plate 22.

While beam 304 has been described in the preferred embodiment as being bridged to flange 302 thereby interrupting slot 300, a protrusion extending from flange 302 toward beam 304 or a protrusion extending from beam 304 toward flange 302 or some combination thereof could provide the same function of emulating the presence of a contact to prevent substantial lateral movement of the beam due to the presence of the protrusion between beam 304 and flange 302.

Beams 204 and 304 have been described as having the same mass as a beam 120 or 122 which they represent in the spacer plate. While beams 204 and 304 in the preferred embodiment do not have the profile of beams 120 or 122 on the side thereof that forms slot 200 or 300, they could have such a profile and thereby be assured to have the same mass and spring characteristics as beams 120 or 122. To obtain the same mass, the sidewall of the slot forming the beam 204 or 304 is shifted until the mass of the respective beam 204 or 304 equals the mass of a beam 120 or 122 which they represent.

Figure 14:
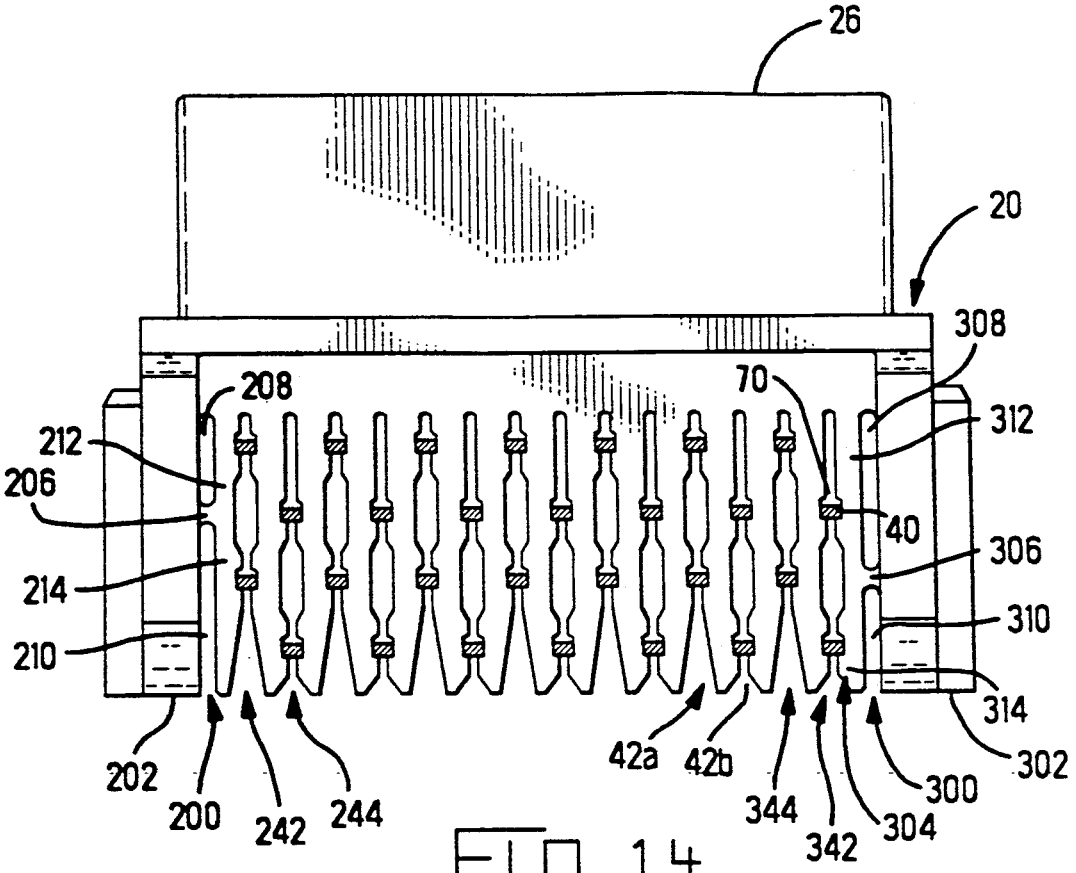
FIG. 14 is a top view of the spacer plate with all four rows of solder tails received in detents.

FIG. 14 shows a top view of a connector having all of the contact solder tails (shown in cross section) received in spacer plate 22.

FIG. 15 shows a partial sectional view of a channel 42, taken from a detent 70 and looking rearward in a channel, taken along the lines 15—15 in FIG. 2. From this view it can be seen that the sidewalls 400,402 of channels 42 are tapered through the thickness of spacer plate 22 from top surface 76 to lower surface 404. Angle 406 between either sidewall 400 or 402 and the vertical in FIG. 15 forms an angle of five (5) degrees.

The sidewalls 100,102 of a detent 70 may or may not be angled at the same angle as sidewalls 400,402. As shown in FIG. 15, sidewalls 100,102 through the region of a detent form an angle 410 with respect to the vertical of two and one half (2.5) degrees.

Figure 16:
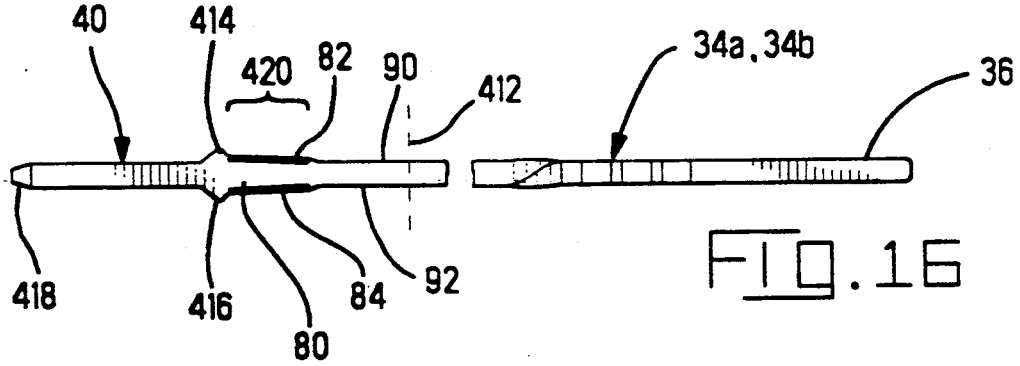
FIG. 16 is a view of a contact from the lower row of the contact receiving passages in the housing.

FIG. 16 shows a typical contact **34*a* or 34*b*, with a middle section removed, before the solder tail is formed proximate line 412 to be substantially perpendicular to mating portion 36. Formed contacts 34*a* and 34*b* are shown in FIG. 1 and are formed by bending solder tail 40 as shown in FIG. 16** out of the paper toward the reader.

Contacts **34*a* and 34*b* have stop protrusions 414 and 416 spaced from distal end 418. Stop protrusions 414,416 extend laterally respectively from sides 90,92 to a tip-to-tip width that exceeds the spacing of the channel defining sidewalls, sidewalls 400,402 in the absence of detents or sidewalls 100,102 when detents are present, where the solder tail is positioned in the assembled connector. In this manner, each protrusion extends beyond a respective sidewall 100,102 in the detent, as best seen in FIG. 17**.

With reference to FIGS. 16 and 17, solder tail 40 is tapered through region 420 that is received in a channel of a spacer plate. In the assembled connector as best seen in FIG. 17, region 420 is above stop protrusions 414 and 416 which are positioned below lower surface 404 upon contact **34*a* or 34*b* being inserted into the housing. The taper of sides 90 and 92 of solder tail 40 through region 420 conforms to the taper of sidewalls 100,102** of the detent in which the solder tail is received.

In this manner the sides 90 and 92 through the region 420 engage sidewalls 100 and 102, respectively, substantially through the entire thickness of spacer plate 22. Furthermore, by tapering channels 42, and particularly the sidewalls 100 and 102 of detents therein, from a larger spacing 424 at the lower surface 404 of spacer plate 22, to a smaller spacing 426 at the upper surface 76 of the spacer plate, any upward displacement of the solder tail of a contact **34*a* or 34*b* would wedge solder tail 40 in the detent. Should solder tail 40 be displaced upwardly, sides 90 and 92 would engage sidewalls 100,102 with increasing normal force, thereby increasingly resisting any further upward displacement of the solder tail. In any event, stop protrusions 416 and 418** prevent any substantial upward movement in accordance with U.S. Pat. No. 4,842,528, the disclosure of which is hereby incorporated by reference.

Figure 18:
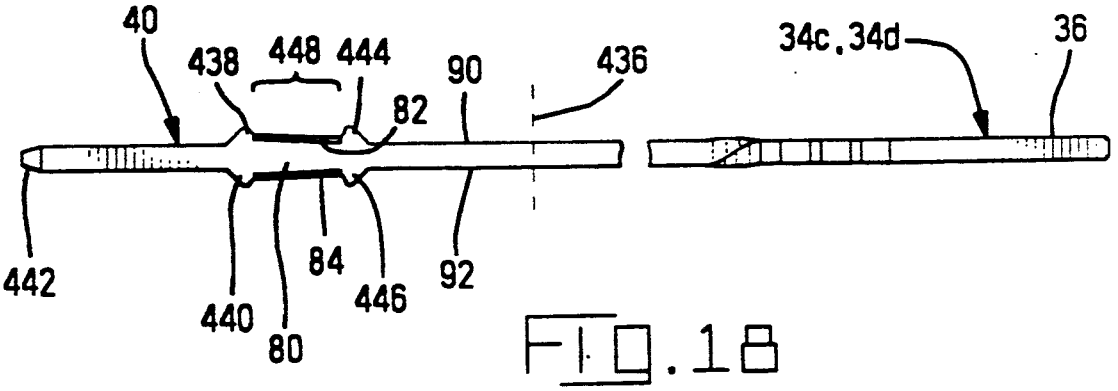
FIG. 18 is a view of a contact from the upper row of contact receiving passages of the housing.

FIG. 18 shows a typical contact 34c or 34d, with a middle section removed, before the solder tail is formed proximate line 436 to be substantially perpendicular to mating portion 36. Formed contacts 34c and 34d are shown in FIG. 1 and are formed by bending solder tail 40 as shown in FIG. 18 out of the taper toward the reader.

Contacts 34c and 34d have lower stop protrusions 438 and 440 spaced from distal end 442. The lower stop protrusions extend laterally respectively from sides 90,92 of a solder tail of a contact 34c or 34d substantially like stop protrusions 414 and 416, to perform the same functions for contacts 34c or 34d that stop protrusions 414 and 416 perform with respect to contacts 34a or 34b.

Solder tails 34c and 34d have upper stop protrusions 444 and 446 spaced upwardly along solder tail 40 from the lower stop protrusions at least the thickness of spacer plate 22. Upper stop protrusions 444 and 446 extend laterally respectively from sides 90,92 to a tip-to-tip width that exceeds the spacing of channel defining sidewalls where the solder tail is positioned in the assembled connector. Upper stop protrusions 444 and 446 substantially prevent solder tail 40 from moving downwardly into spacer plate 22. Contacts 34c and 34d are more susceptible to downward movements in spacer plate 22 than are contacts 34a and 34b as contacts 34c and 34d are exposed behind rear housing face 28.

As best seen in FIGS. 3 and 19, lower stop protrusions 438 and 440 are positioned below lower surface 404 of the spacer plate and upper stop protrusions 444 and 446 are positioned above upper surface 76 of the spacer plate when contact 34c or 34d is being inserted into or is secured in the connector.

Sides 90 and 92 of contacts 34c and 34d through region 448 engage sidewalls 100 and 102, respectively, substantially through the entire thickness of spacer plate 22. Furthermore, by tapering channels 42, and particularly the sidewalls 100 and 102 of detents therein, from a large spacing 424 at the lower surface 404 of spacer plate 22, to a smaller spacing 426 at the upper surface 76 of the spacer plate, any upward displacement of the solder tail of a contact 34c or 34d would wedge solder tail 40 in the detent. Should solder tail 40 be displaced upwardly sides 90 and 92 would engage sidewalls 100,102 with increasing normal force, thereby increasingly resisting any further upward displacement of the solder tail. In any event, lower stop protrusions 438 and 440 provide a back-up stop that prevents any large movement of solder tail 40 upward through spacer plate 22. Upper stop protrusions 444 and 446 substantially prevent downward movement of solder tail 40 through spacer plate 22 in accordance with the teaching of U.S. Pat. No. 4,842,528.

The beams of the spacer plate function as described above within the plastic range. With no solder tails received in the spacer plate and the beams unbiased, smaller spacing 426 between sidewalls 100 and 102 of detents 70 at upper surface 76 are the same in each of rows 58,60,62 and 64. In other words, the spacer plate is molded such that the width of each of the detents is the same.

Figure 20:
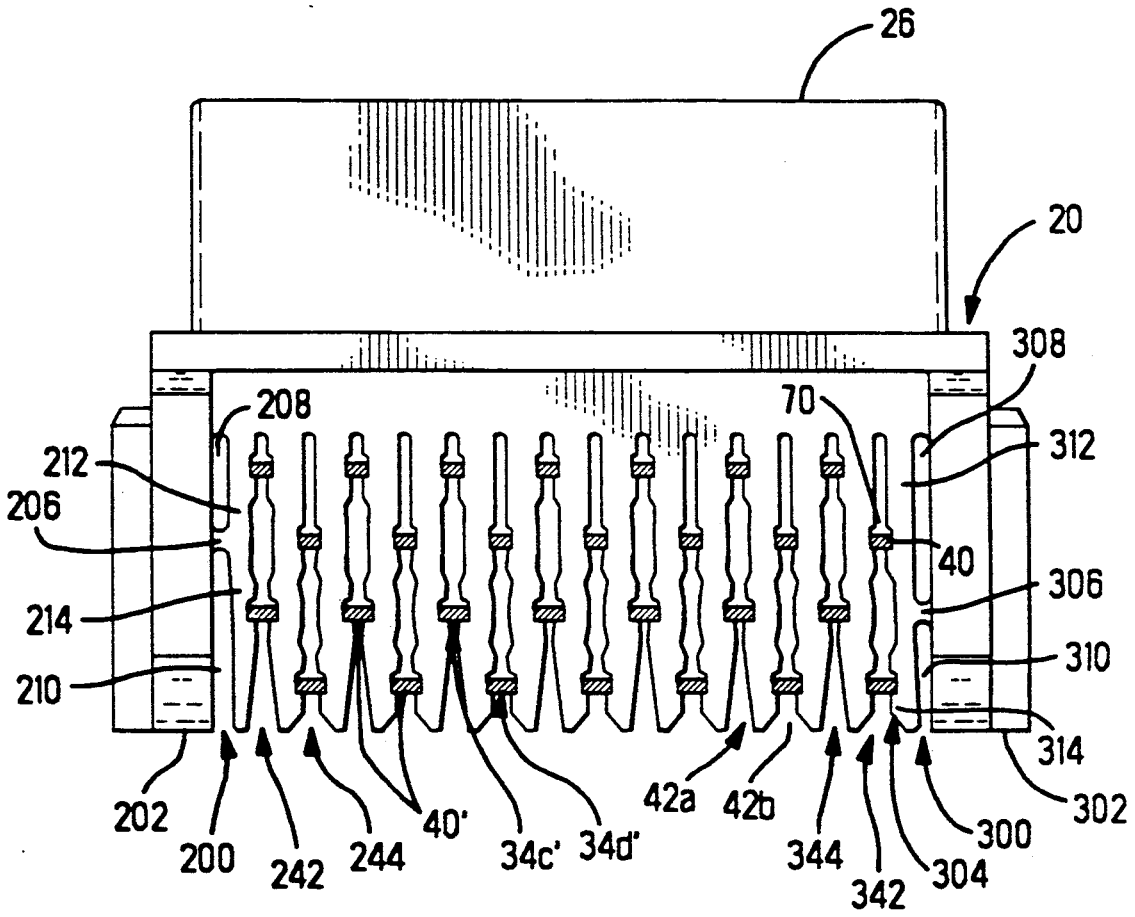
FIG. 20 is a view similar to FIG. 14 in which the two rear rows of solder tails are wider than the more forward rows of solder tails.

As shown in FIG. 20, the solder tails 40' of contacts 34d' received in at least the rearward detent 74 in channels 42b, that is in the rearmost row of detents 64, are wider through tapered region 448 than the detents with the beams in the unbiased position and wider than the solder tails 40 received in the more forward rows of detents 62,60 and 58.

Each of the beams securing solder tails 40' in detents 74 in row 64 are deformed slightly and are more biased through effective beam length 176 than if the solder tails received in rearward detents 74 of channels 42b were substantially the same width as the detents, or the solder tails received in the other rows of detents. In this manner, solder tails 40' of contacts 34d' are received in respective detents in an interference fit in which the lateral forces on sides 90 and 92 are greater than the lateral force, if any, on the sides of solder tails of contacts 34c,34b or 34a. This increased lateral force on the solder tails in the rearmost row 64 provides enhanced retention of solder tails in the detents in row 64 to prevent the solder tails from backing out of a detent or channel such as when inadvertently bumped out of the detents during shipping or handling. The greater lateral force pushes equally on all solder tails in row 64 and further maintains the distal ends 442 in their true positions.

The effect of a greater lateral force on solder tails to retain the solder tails in the detents and to maintain the true position of distal ends of the solder tails can be further enhanced by also employing contacts in the rearward detent 74 of channels 42a that is in row of detents 62 that are wider than the detents with the beams in the unbiased position and wider than the solder tails 40 received in the more forward rows of detents 60 and 58. In this manner, when solder tails 40' of contacts 34c' are inserted into channels 42 and seated in rearward detents 74 in channels 42a, the beams deflect through an effective beam length 166. With a solder tail seated in each of the detents in row 62 where the solder tail is wider than the detent was prior to insertion of the solder tail, the beams are deformed slightly, bending away from solder tails 40' in row 62. This results in the width of detents 74 in row 64 immediately prior to insertion of solder tails 40' of contacts 34d' being less than the width of the detents with the beams in an unbiased position.

Thus, when solder tails 40' of contacts 34d' are passed into channels 42b and seated in rearward detents 74, each of the beams securing the solder tails of contacts 34d' in detents 74 of row 64 are deformed even more than described above, due to the presence of a wider solder tail 40' on contact 34c' seated in detent 74 of channels 42a.

The interference fit between the solder tails in rows 62 and 64 in the detents in which they are received cause the beams to deform resiliently within the plastic range causing an increased lateral force on the sides of the solder tails in detents in rows 62 and 64. The structure of the beams with the solder tails secured therebetween become a rigid or solid member that maintains the true position of the distal ends of the solder tails. This increased lateral force assures engagement between a sidewall of the channel, in the region of a detent when detents are present, and the side edge of a solder tail received therein. The increased lateral force reacts equally with all solder tails in a row to retain the solder tails and hence the distal ends thereof in their true position.

While it has been found to be sufficient to use uniform width detents and solder tails that are substantially the same width as the detents in the forward rows of the spacer plate and wider solder tails in the rearmost row of two of the spacer plate, the solder tails could be progressively wider by row from front to rear of the spacer plate. Alternatively, narrower detents in one or more rear rows of the spacer plate cooperating with solder tails that are of the same width as solder tails received in the more forward rows would result in a greater lateral force on the rearmost solder tails when positioned in a spacer plate as set forth above.

In a preferred embodiment, smaller spacing 426 between sidewalls 100 and 102 of a detent 70 at upper surface 76 of spacer plate 22 is 0.023 inch (0.58 mm). The channels 42 are tapered five degrees from being orthogonal to the upper surface 76 or the lower surface 404 of spacer plate 22. In the preferred embodiment surfaces 76 and 404 are substantially parallel. The detents 70 are tapered two and one half degrees from being orthogonal to the upper surface. The channels 42 and detents 74 widen from upper surface 76 to lower surface 404 through the thickness of 0.047 inch (1.19 mm) of the spacer plate. Sides 90 and 92 of the solder tails of contacts 34*a* and 34*b* taper two and one half degrees from being parallel to a centerline of the solder tail (not shown) through region 420 which is 0.061 inch (1.55 mm) long above stop protrusions 414 and 416 from a wider end of 0.024 inch (0.61 mm) to a narrower end of about 0.020 inch (0.51 mm). This taper conforms to the taper of the detent walls. Sides 90 and 92 of solder tails of contacts 34*c'* and 34*d'* taper two and one half degrees through region 448 which is 0.061 inch long (1.55 mm) between lower stop protrusions 438,440 and upper stop protrusions 444,446 from a wider end of 0.028 inch (0.71 mm) to a narrower end of 0.024 inch (0.61 mm). This taper conforms to the taper of the detent walls.

We claim:

1. An electrical connector, comprising:

a dielectric housing having contacts secured therein, each of said contacts having a solder tail defining side profile edges, said side profile edges defining therebetween the width of the solder tail;

a spacer plate extending rearwardly from proximate said housing to a rear face, said spacer plate having first and second surfaces defining therebetween the thickness of said spacer plate, said spacer plate having a plurality of solder tail receiving channels extending forward from said rear face toward said housing and through said spacer plate from said first surface to said second surface, said channels defined by opposed sidewalls, having portions in the region where solder tails are positioned that are of substantially uniform width, the solder tails being received in said channels to form at least two rows across the spacer plate, one row being a rearward row and the other of said at least two rows being a more forward row, the solder tails received in the rearward row being wider than the solder tails in the more forward row, whereby the solder tails in said rows are received in said uniform width portions.

2. An electrical connector as recited in claim 1, wherein the solder tails form at least three rows, a forward row and two rearward rows, the solder tails received in the two rearward rows being wider than the solder tails received in the forward row.

3. An electrical connector as recited in claim 2, wherein the solder tails received in the two rearward rows are the same width.

4. An electrical connector as recited in claim 3, wherein the recesses in the adjacent channels are not laterally aligned whereby the recesses in adjacent channels are staggered.

5. An electrical connector as recited in claim 3, wherein the recesses in the adjacent rows are not laterally aligned whereby the recesses in adjacent channels are staggered.

6. An electrical connector, comprising:

a dielectric housing having contacts secured therein, each of said contacts having a solder tail, each said solder tail having side profile edges defining therebetween the width of the solder tail;

a spacer plate extending rearwardly from proximate said housing to a rear face, said spacer plate having an upper first surface and a lower second surface defining therebetween the thickness of said spacer plate, said spacer plate having a plurality of solder tail receiving channels extending forward from said rear face toward said housing and extending through said spacer plate from said first surface to said second surface, said channels defined by opposed sidewalls, each of said channels having at least one recess therein defined by opposed recesses in said opposed sidewalls, the recesses each defining a widened sidewall spacing therethrough of substantially the same width, the solder tails received in said recesses forming at least two rows across the spacer plate, one row being a rearward row and the other row being a more forward row, the solder tails received in the rearward row being wider than the solder tails received in the more forward row, whereby the solder tails are received in said recesses of substantially uniform width.

7. An electrical connector as recited in claim 6, wherein the solder tails form at least three rows, a forward row and two rearward rows, the solder tails received in the two rearward rows being wider than the solder tails received in the forward row.

8. An electrical connector as recited in claim 7, wherein the solder tails received in the two rearward rows are the same width.

* * * * *